US008700371B2

(12) United States Patent
Thambynayagam et al.

(10) Patent No.: US 8,700,371 B2
(45) Date of Patent: Apr. 15, 2014

(54) SYSTEM AND METHOD FOR CONTROLLING AN ADVANCING FLUID FRONT OF A RESERVOIR

(75) Inventors: Michael K. M. Thambynayagam, Sugar Land, TX (US); Gregory P. Grove, Houston, TX (US); Colin Atkinson, South Harrow (GB); Raj Banerjee, Abingdon (GB); Jeffrey B. Spath, Missouri City, TX (US); Amina Boughrara, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 472 days.

(21) Appl. No.: 12/837,550

(22) Filed: Jul. 16, 2010

(65) Prior Publication Data

US 2012/0016649 A1 Jan. 19, 2012

(51) Int. Cl.

| | |
|---|---|
| ***G06G 7/48*** | (2006.01) |
| ***E21B 49/00*** | (2006.01) |
| ***E21B 47/00*** | (2012.01) |
| ***E21B 43/00*** | (2006.01) |
| ***E21B 43/12*** | (2006.01) |

(52) U.S. Cl.
USPC ..... 703/10; 166/53; 166/66; 166/252.4; 166/250.15; 702/12; 702/50

(58) Field of Classification Search
USPC ..... 703/10; 166/53, 66, 252.4, 250.15; 702/12, 50
See application file for complete search history.

(56) References Cited

U.S. PATENT DOCUMENTS

| | | | | |
|---|---|---|---|---|
| 4,114,687 | A * | 9/1978 | Payton | 166/276 |
| 4,114,691 | A * | 9/1978 | Payton | 166/276 |
| 6,778,918 | B2 | 8/2004 | Delhomme et al. | |
| 7,055,600 | B2 * | 6/2006 | Messier et al. | 166/250.01 |
| 7,069,148 | B2 * | 6/2006 | Thambynayagam et al. | 702/12 |
| 7,725,302 | B2 * | 5/2010 | Ayan et al. | 703/10 |
| 8,307,893 | B2 * | 11/2012 | Sierra et al. | 166/245 |
| 8,424,609 | B2 * | 4/2013 | Duphorne et al. | 166/373 |
| 2002/0027004 | A1 | 3/2002 | Bussear et al. | |
| 2002/0092701 | A1 * | 7/2002 | Norris et al. | 181/102 |
| 2003/0201098 | A1 * | 10/2003 | Karanikas et al. | 702/12 |
| 2003/0220750 | A1 * | 11/2003 | Delhomme et al. | 702/50 |
| 2005/0119911 | A1 * | 6/2005 | Ayan et al. | 705/1 |
| 2006/0069511 | A1 * | 3/2006 | Thambynayagam et al. | 702/12 |

(Continued)

OTHER PUBLICATIONS

Penmatcha, "A comprehensive reservoir/wellbore model for horizontal wells", 1998 SPE India Oil and Gas Conference and Exhibition, New Delhi, India, Feb. 17, 1998, SPE 39521, pp. 1-14.

(Continued)

*Primary Examiner* — Akash Saxena

(57) ABSTRACT

A system and method for controlling an advancing water front in a reservoir toward a wellbore is provided. The system has a production control unit. The production control unit has a reservoir unit for producing a reservoir model and a production path unit for producing a production path model that determines at least one pressure parameter about the wellbore during a life of the wellbore. The production control unit has a production optimizer unit for producing a well plan that optimizes a function of the wellsite. The production control unit may be for controlling an advancing fluid front in the reservoir with at least one control device, and wherein a production path is constructed based on the well plan.

20 Claims, 6 Drawing Sheets

(56) References Cited

U.S. PATENT DOCUMENTS

| | | | | |
|---|---|---|---|---|
| 2007/0143020 | A1* | 6/2007 | Bradford et al. | 702/6 |
| 2007/0198223 | A1* | 8/2007 | Ella et al. | 702/188 |
| 2008/0149203 | A1 | 6/2008 | Atkinson et al. | |
| 2009/0164188 | A1* | 6/2009 | Habashy et al. | 703/10 |
| 2009/0294122 | A1* | 12/2009 | Hansen et al. | 166/250.01 |
| 2011/0040543 | A1* | 2/2011 | Nunez et al. | 703/10 |
| 2011/0226481 | A1* | 9/2011 | Duphorne et al. | 166/313 |
| 2012/0016649 | A1* | 1/2012 | Thambynayagam et al. | 703/10 |
| 2013/0153215 | A1* | 6/2013 | Scott et al. | 166/252.1 |
| 2013/0186618 | A1* | 7/2013 | Khisamov et al. | 166/250.17 |

OTHER PUBLICATIONS

Thompson, "Modeling of flow in a near-wellbore network", Proceedings of the ASME 2009 28th International Conference on Ocean, Offshore and Arctic Engineering, Honolulu, Hawaii, USA, May 31, 2009, OMAE2009-79808, pp. 1-7.

Atkinson, "Flow performance of horizontal wells with inflow control devices", Euro. Jnl of Applied Mathematics (2004), vol. 15, pp. 409-450, 2004 Cambridge Press, DOI: 10.1017/S0956792504005546.

Neylon, "Modeling well inflow control with flow in both annulus and tubing", 2009 SPE Reservoir Simulation Symposium, The Woodlands, Texas, USA, Feb. 2, 2009, SPE 118909, pp. 1-13.

Green, D. et al., "Perry's Chemical Engineer's Handbook", McGraw-Hill Professional, 2007, p. 794.

* cited by examiner

SYSTEM AND METHOD FOR CONTROLLING AN ADVANCING FLUID FRONT OF A RESERVOIR

BACKGROUND

The invention relates to techniques for performing oilfield operations relating to subterranean formations having reservoirs therein. More particularly, the invention relates to techniques for performing adaptive production operations based on predetermined and updated wellsite parameters to, for example, control a fluid front in a reservoir.

Oilfield operations are typically performed to locate and gather valuable downhole fluids. Typical oilfield operations may include, for example, surveying, drilling, wireline testing, completions, production, planning, and oilfield analysis. One such operation is the drilling operation which involves advancing a drilling tool into the earth to form a wellbore. Drilling of extended reach horizontal wells has become a routine activity in the oil-field. The extended reach wells achieve greater reservoir contact. The cost of drilling a horizontal well is greater than that of a vertical well. However, horizontal wells drilled in an area having conductive reservoir properties and drive mechanisms, may produce at higher rates than a vertical well with the same or lower pressure drawdown. Oil production rates may be three to twenty times higher in horizontal wells than in vertical wells. Horizontal wells are prone to premature breakthrough of unwanted fluids, such as water, through high permeability conduits and fluid coning toward a heal of the well. The risk of premature breakthrough may increase when the primary production mechanism is bottom-water-drive.

A production portion of a wellbore may be completed by running a liner into the wellbore, cementing the annulus and perforating the liner and annulus. Further, sand screens may be deployed in an open wellbore. The sand screens may prevent coarser sand grains from entering the wellbore. Irrespective of the type of completion used, the frictional pressure drop along the production portion of the wellbore may cause an uneven inflow fluid flux distribution, or the heel-to-toe effect. The heel-to-toe effect may propagate an uneven advancement of the fluid front (or waterfront) which may result in premature breakthroughs. Further, premature breakthroughs may occur in a horizontal well when the permeability of one portion of the reservoir is higher than other portions of the reservoir. Production in the high permeability portion of the well is greater than the other portions of the reservoir. The higher production rates cause the valuable fluids, such as hydrocarbons, to be produced rapidly. Water, or other unwanted fluids, may approach the wellbore at a higher rate in the high permeability portion of the reservoir than the other portions of the reservoir. As the fluid reaches the wellbore, the fluid may create a conduit that allows subsurface fluid to reach the wellbore. The fluid may damage and/or destroy production at the wellbore.

To control premature breakthrough, drillers have attempted to place control valves in the wellbore. The control valves may be closed if water, and/or other unwanted fluids are found in the production tubing. Further, attempts have been made to provide advanced techniques for controlling premature breakthrough as described. Examples of flow control techniques are described in US Patent Application No. 2008/0149203.

Despite the existence of techniques for controlling premature breakthrough there remains a need to design drilling and completion operations based on a better understanding of the wellsite. It is desirable that such techniques take into consideration the reservoir properties prior to completing the wellbore. It is further desirable that such techniques locate production equipment in the wellbore based on the reservoir properties in order to prevent premature breakthrough. Such techniques are preferably capable of one or more of the following, among others: controlling the heel-to-toe effect, reducing formation damage, minimizing sand production, improving well clean up, optimizing production, reducing costs, reducing risks, reducing uncertainties, collecting data in real time, analyzing data in real time, updating operations in real time, adjusting operations in real time, providing a reliable analysis, and providing efficient data acquisition.

SUMMARY

The invention relates to an integrated production control unit for controlling an advancing fluid front in a reservoir toward a wellbore at a wellsite. The production control unit has a reservoir model unit for producing a reservoir model, a production path unit for producing a production path model that determines at least one pressure parameter about the wellbore during a life of the wellbore, and a production optimizer unit for producing a well plan that optimizes a function of the wellsite. At least one of the functions of the production control unit may be controlling an advancing fluid front in the reservoir with at least one control device, and wherein a production path is constructed based on the well plan.

The invention relates to a system for controlling an advancing fluid front in a reservoir toward a wellbore at a wellsite. The system comprises a production path located in the wellbore for producing fluids from the reservoir. The production path has a base pipe for flowing the fluids from the reservoir and at least one control device for controlling the flow of the fluids from the reservoir into the base pipe. The system further comprises a production control unit. The production control unit has a reservoir model unit for producing a reservoir model, a production path unit for producing a production path model that determines at least one pressure parameter about the wellbore during a life of the wellbore, and a production optimizer unit for producing a well plan that optimizes a function of the wellsite. At least one of the functions of the production control unit may be controlling an advancing fluid front in the reservoir.

The invention relates to a method for controlling an advancing fluid front in a reservoir toward a wellbore at a wellsite. The method comprises providing a production control unit. The production control unit has a reservoir model unit for producing a reservoir model, a production path unit for producing a production path model that determines at least one pressure parameter about the wellbore during a life of the wellbore, and a production optimizer unit for producing a well plan that optimizes a function of the wellsite. At least one of the functions of the production optimizer unit may be controlling an advancing fluid front in the reservoir. The method further comprises creating an optimized simulation model based on the reservoir model and the production path model, creating an initial production path based on the well plan based on the optimized simulation model, and constructing a production path having at least one control device based on the initial production path.

BRIEF DESCRIPTION OF THE DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
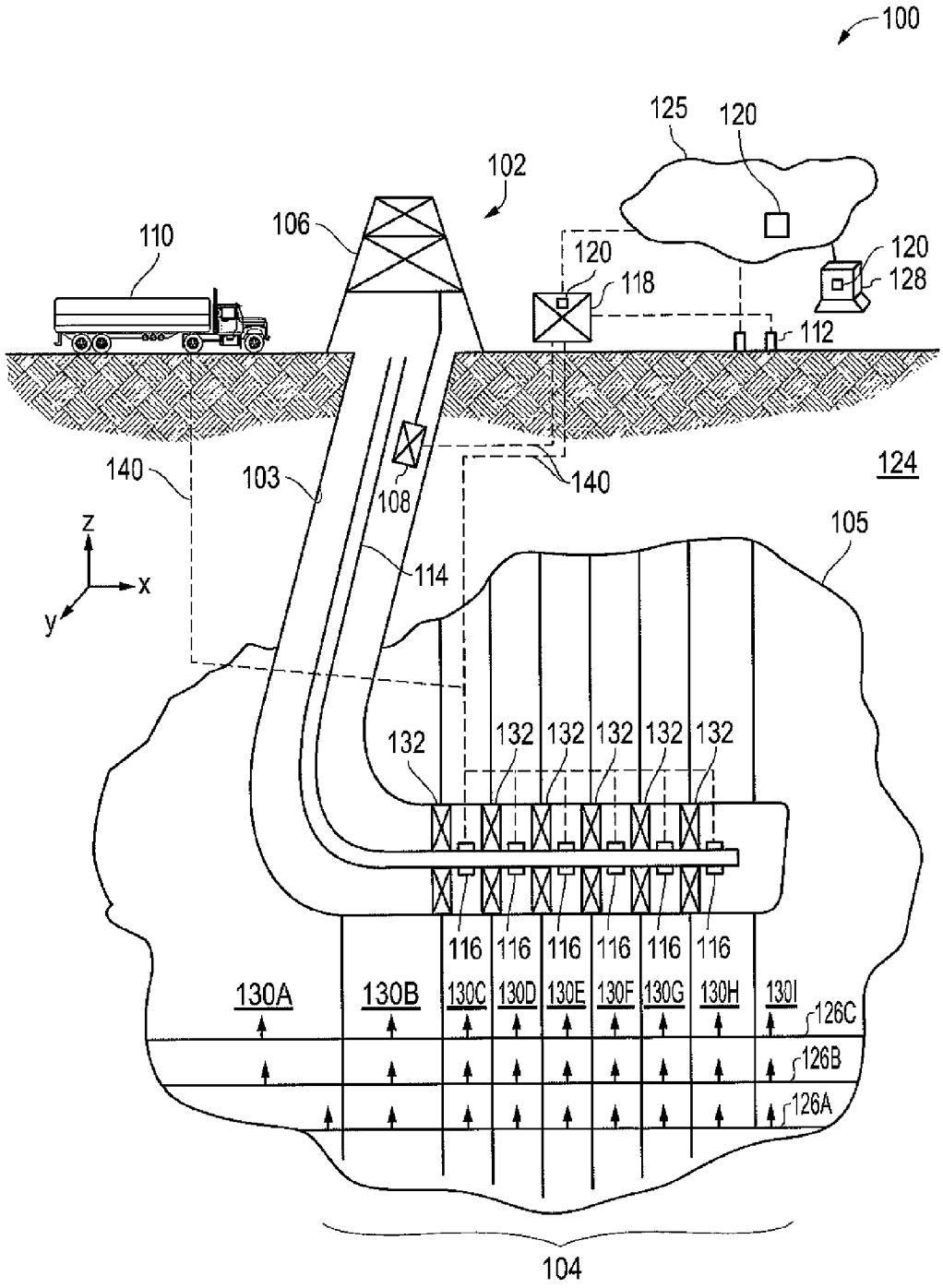
FIG. 1 is a schematic diagram, partially in cross-section, depicting a wellsite having a system for controlling an advancing fluid front at the wellsite comprising a plurality of control devices.

FIG. 1 shows a schematic diagram depicting a wellsite 100 having a production control system 102. As shown, the wellsite 100 is a land based wellsite, but could also be water based. The wellsite 100 may have a wellbore 103 which has a horizontal (or deviated) portion 104 that cuts through a reservoir 105. The wellsite 100 may include any number of associated wellsite equipment, such as a drilling rig 106, a logging tool 108, a seismic wave inducing tool 110, one or more receivers 112, a conveyance 114, one or more control devices 116 (or flow control devices) and a controller 118. The controller 118 may have a production control unit 120. The production control unit 120 may control the flow of unwanted fluids towards the wellbore 103 as will be described further herein.

The conveyance 114 may be any suitable conveyance for forming and/or producing the wellbore 103 including, but not limited to, a production tubing, a drill string, a casing string, coiled tubing, and the like. Additional downhole tools, devices and systems for performing drilling, completions, production and/or other wellsite operations may be used at the wellsite 100, such as drilling tools, logging tools, sensors, production tools, monitors, drill bit steering tools, whipstocks, packers, downhole pumps, valves, and the like.

The controller 118 may send and receive data to and/or from any of the tools, devices and/or systems associated with the wellsite 100, such as the multiple control devices 116, the logging tool 108, a seismic wave inducing tool 110, one or more receivers 112, the network 125, the one or more offsite communication devices 128 and/or any suitable equipment located about the wellsite 100. The system 102 may include a network 125 for communicating between the well-site 100 components, systems, devices and/or tools. Further, the network 125 may communicate with one or more offsite communication devices 128 such as computers, personal digital assistants, and the like. The network 125 and the controller 118 may communicate with any of the tools, devices and systems using any combination of communication devices or methods including, but not limited to, wired, telemetry, wireless, fiber optics, acoustic, infrared, a local area network (LAN), a personal area network (PAN), and/or a wide area network (WAN). The connection may be made via the network 125 to an external computer (for example, through the Internet using an Internet Service Provider) and the like. The production control unit 120 may be partially and/or wholly located at the controller 118, the network 125, the offsite communication devices 128, and/or the logging tool 108.

The wellsite 100 as shown has multiple control devices 116 extending along the horizontal portion 104 of the wellbore 103. The multiple control devices 116, in combination with the production control unit 120, may assist in the ability to control a heel-to-toe effect and/or premature breakthrough of a fluid front 126A-C. As shown in FIG. 1, the fluid front 126A-C is shown as a series of three straight lines located below and advancing toward the wellbore 103 over time as indicated by the arrows. The straight line of the fluid front 126A may represent the initial location of the fluid front 126A prior to production of the reservoir 105. The fluid front 126B represents the fluid front during the production of the reservoir 105. The fluid front 126C represents the fluid front near the end of production of the reservoir 105. The production control unit 120 may be configured to control the advancement of the fluid front 126A-C as the reservoir 105 is produced. The production control unit 120 may maintain the advancing fluid front 126A-126C in a substantially uniform manner thereby reducing the risk of premature breakthrough, as will be described in more detail below.

The control devices 116 may be located in the horizontal portion 104 of the wellbore 103 at one or more optimal locations. The optimal locations may be selected by the production control unit 120, as will be described in more detail below. The optimal locations may be configured to place the control devices 116 in one or more reservoir permeability zones 130A-130I. The reservoir 105 has been divided into a plurality of vertical slices defining the permeability zones 130A-I. Each of the reservoir permeability zones 130A-130I may have varying degrees of permeability. Between the control devices 116 there may be one or more annular flow controllers 132, such as a packer, cement and the like. The control devices 116 and the annular flow controllers 132 may substantially isolate the wellbore 103 at each of the one or more reservoir permeability zones 130A-130I. This configuration preferably places each of the control devices 116 (and/or a group of control devices 116) in fluid communication with each of the reservoir permeability zones 130A-130I.

Figure 2:
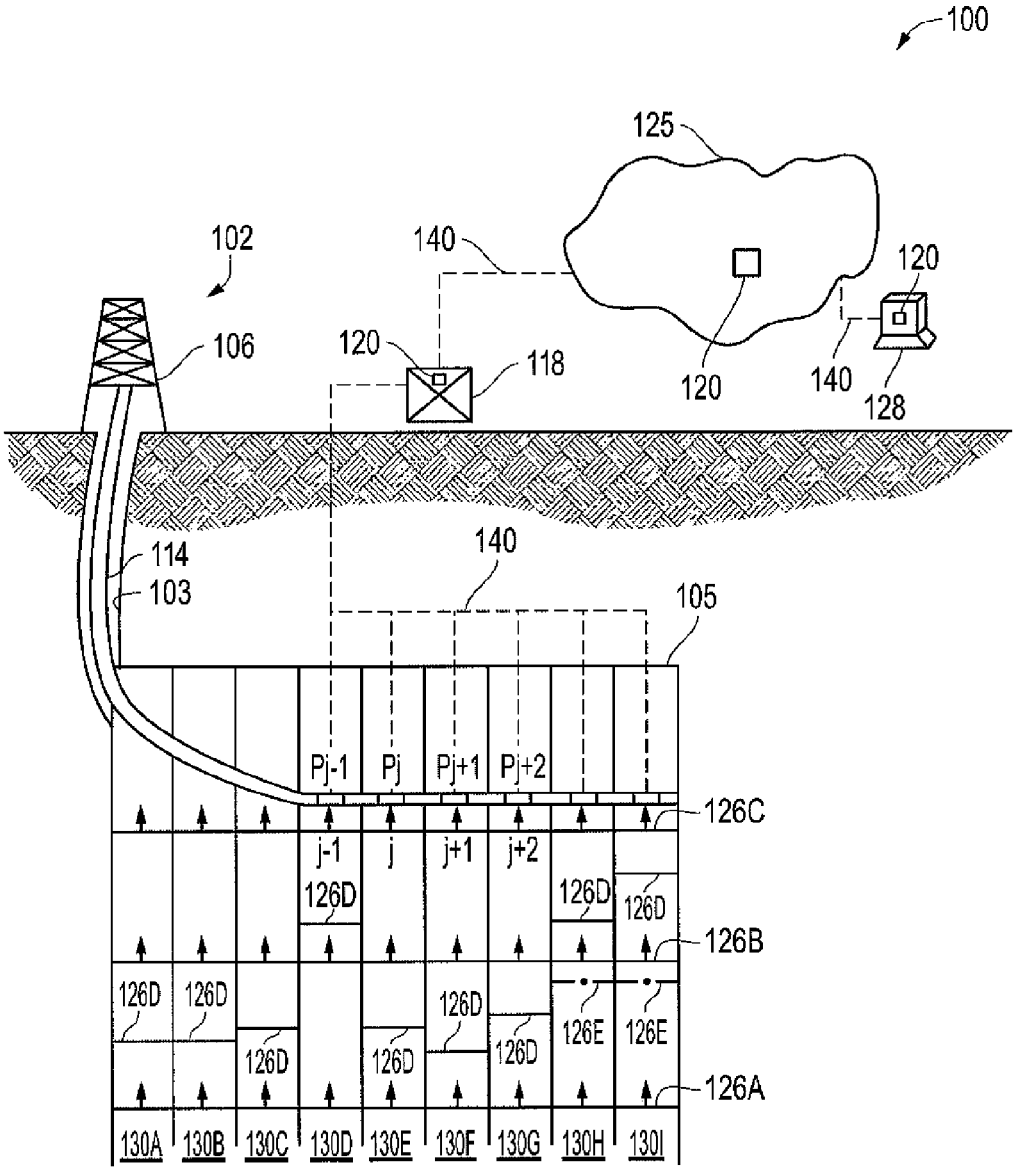
FIG. 2 is a schematic diagram, depicting the wellsite of FIG. 1 and varying production techniques used therewith.

FIG. 2 shows an alternate schematic diagram depicting the wellsite 100 of FIG. 1. In this depiction, the wellsite 100 has a production control system 102, and illustrates the advancing fluid front 126A-C in the reservoir 105 using various production techniques. The advancing fluid front 126D may represent an advancing fluid front when the production control system 102 is not used. Thus, the advancing fluid front 126D may advance faster in some of the permeability zones, such as 130H and 130I, and slower in other permeability zones, such as 130C and 130E. If the production control system 102 is used, the advancing fluid front 126A-D may be substantially uniform. As shown, the permeability zones 130H and 130I have a higher permeability than the other permeability zones 130A-G, as shown by the faster advancement of the advancing fluid front 126D and 126E. However, using the production control system 102, the advancing fluid front 126A-C and 126E may remain substantially flat and/or uniform.

Figure 3:
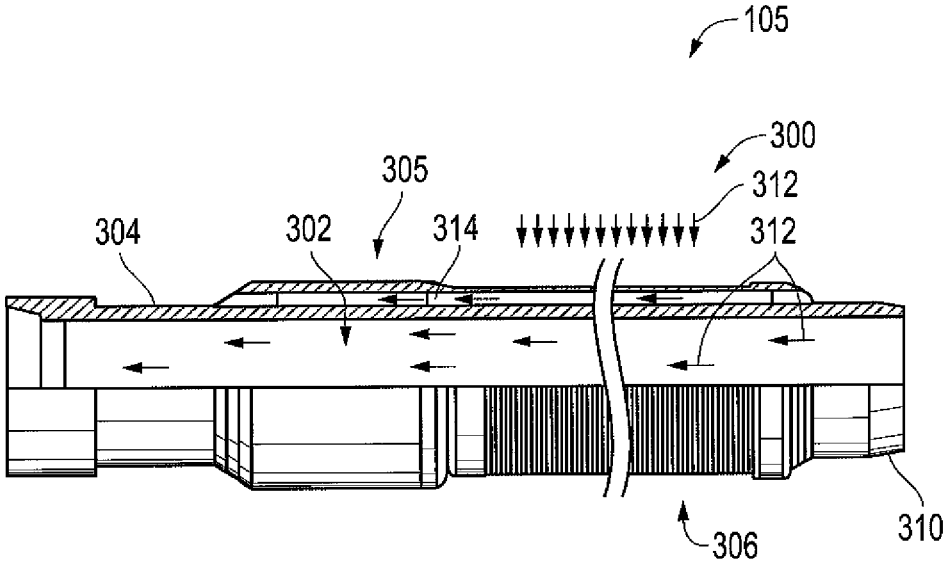
FIG. 3 is a schematic view of a control device of FIG. 1 for controlling the flow of fluids into a base pipe.
Figure 4A:
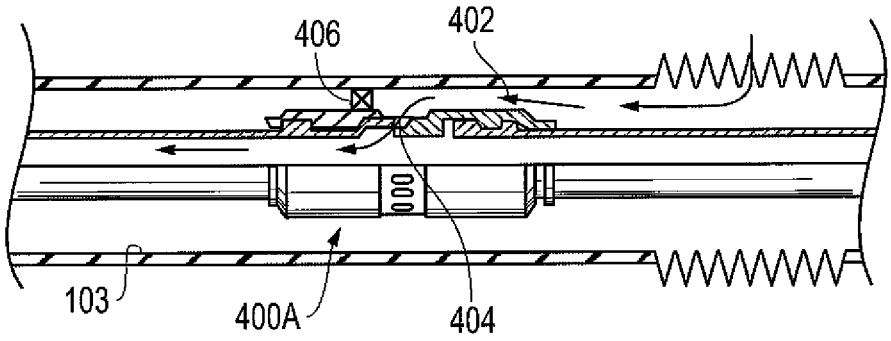
FIGS. 4A and 4B are schematic views of a control device of FIG. 1 for controlling the flow of fluids into a base pipe.
Figure 4B:
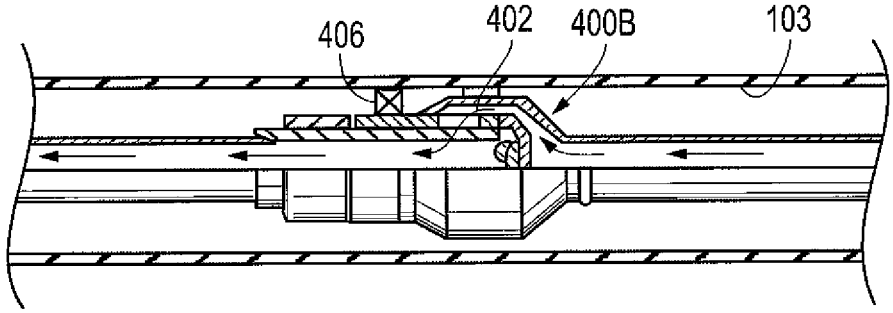

Referring to FIGS. 1, 3 and 4A-4B, the multiple control devices 116 may be any combination of control devices that allow fluids from the reservoir 105 to enter the conveyance 114 in a controlled manner. For example, the control devices 116 may be one or more inflow control devices (ICDs) 300 (as shown in FIG. 3), one or more inflow control valves (FCV) 400A, 400B (as shown in FIGS. 4A and 4B), or a combination thereof. Fluid coning and heel-toe-effect may happen even in a relatively homogeneous reservoir, such as reservoir 105 having similar reservoir permeability zones 130A-I. These reservoirs 105 may be candidates for installation of ICD(s) 300 type inflow control devices. While IDC(s) 300 may be used in any well, controlling the heel-to-toe effect in a heterogeneous reservoir, or reservoir 105 having dissimilar permeability zones 130, may be more complicated. In some cases, the heterogeneous reservoirs 105 may be candidates for installation of FCV(s) 400 type inflow control devices. The location and implementation of the annular flow controllers 132 (e.g., packers) and/or the control devices 116 may prevent cross-flow, or flow between the permeability zones 130, in homogeneous and/or heterogeneous reservoirs.

FIG. 3 shows a schematic view of the inflow control device (ICD) 300 of FIG. 1. As shown in this view, the ICD 300 may consist of a set of nozzles 302 integrated into the joint of a base pipe 304. Part or the entire base pipe may be covered with a screen 306, such as a metal screen.

The base pipe 304 may form a ICD joint 305 having a box end 308 and a pin end 310. The screen 306 may prevent the entry of coarse sands which could block the nozzles 302 into the ICD 300. The ICD joint may be any length and may be sized by the production control unit 120, for example, the ICD joint 305 may be about 12 m long. The horizontal portion 104 of the wellbore 103 may consist of a large number of the ICD joints 305 attached to each other with box and pin connections, such as box end 308 and pin end 310.

A fluid 312 from the reservoir 105 may pass through the screen 306 into an ICD annulus 314. The fluid 312 may then flow through the nozzle(s) 302 and into the base pipe 304. The ICD(s) 300 may passively regulate inflow into the base pipe 304 so that high-velocity flow regions are choked back. The passively regulated inflow may result in a more uniform inflow profile along the horizontal portion 104 of the wellbore 103 (as shown in FIG. 1). The ICD 300 configuration and/or spacing may be determined prior to deployment into the wellbore 103. The ICD configuration may be kept unchanged throughout the life of the well.

The production control unit 120 may define various parameters for equipment used in connection with the wellsite 100, such as those depicted in FIGS. 1-3B. The number and/or size of nozzles 302 may be modified prior to being run into the wellbore 103. The length and type of the screen 306 may be modified prior to being run into the wellbore 103 by the production control unit 120. Further, the production control unit 120 may determine the length and type of screen 306 used in each of the ICDs 300. The production control unit 120 may determine the optimal number, size and type of nozzles 302. The nozzles 302 sizes may be for example, 1.6 mm, 2.5 mm or 4.0 mm in diameter. For an 8.5" (21.59 cm) open hole the base pipe 304 may have an inner diameter of 5.5" (13.97 cm).

FIGS. 4A and 4B show a schematic view of various valves 400A, B that may be used as the control devices 116 of FIG. 1. FIG. 4A shows an example of an annular inflow control valve (AFCV) 400A. FIG. 4B shows an example of an in-line inflow control valve (IFCV) 400B. The AFCV 400A and/or the IFCV 400B may have a valve 402 and/or controllable nozzle for modifying the flow parameters in the wellbore 103. Thus, the size of an orifice 404 and/or nozzle may be remotely controlled during the producing life of the wellbore 103. The FCV(s) 400A and/or 400B may include any number of sensors 406 for detecting downhole conditions, such as temperature, pressure, flow rate, fluid composition and the like. The AFCV 400A, the IFCV 400B, and/or the sensors 406 may be in communication with the controller 118 and/or the production control unit 120 via the one or more communication links 140.

Figure 5:
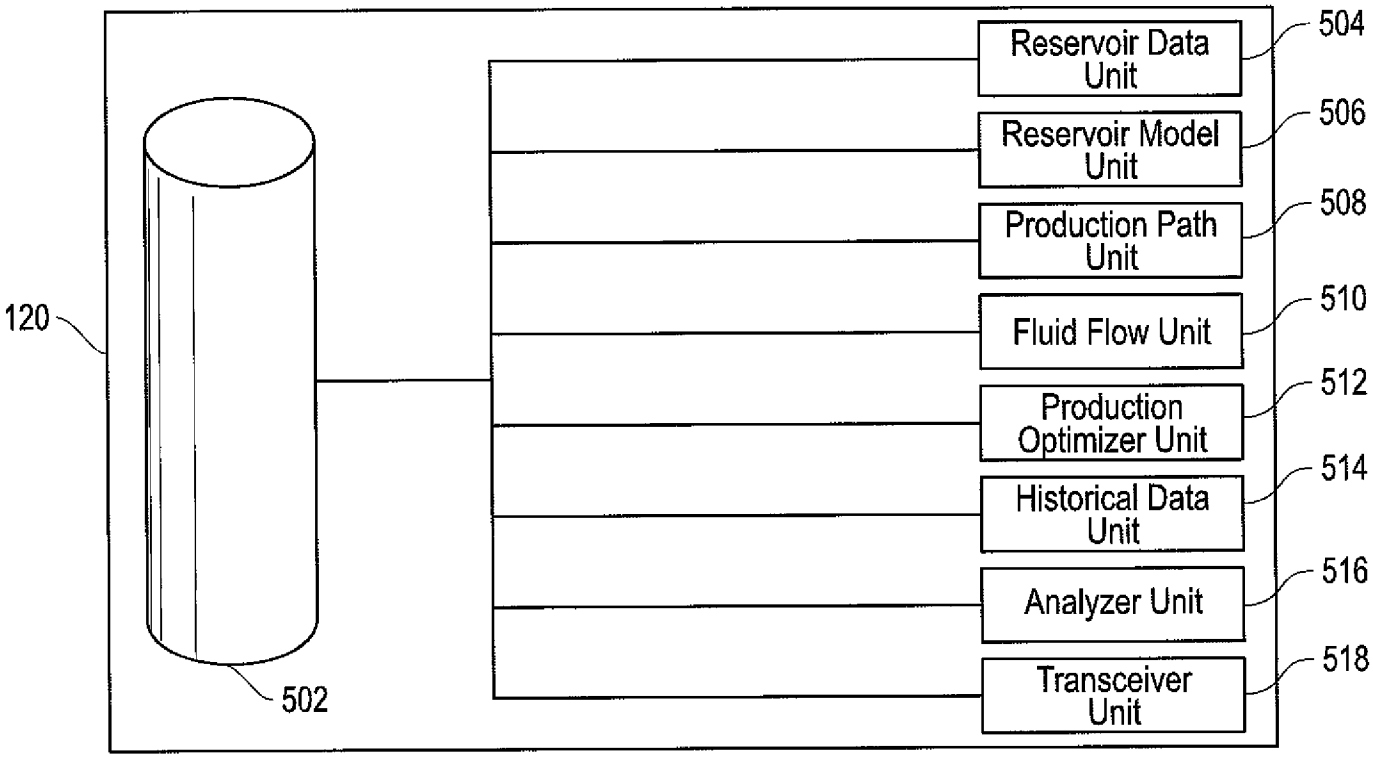
FIG. 5 depicts a block diagram illustrating a production control unit of FIG. 1, wherein the production control unit is for controlling the advancing fluid front at the wellsite.

FIG. 5 depicts a block diagram illustrating the production control unit 120 of FIG. 1. The production control unit 120 may be incorporated into or about the wellsite 100 (on or off site) for operation with the controller 118. The production control unit 120 may model various parameters of the system 102 in order to optimize an objective function of the advancing fluid front 126. The production control unit 120 may model, for example, the 1) reservoir 105, 2) a production path, and/or 3) a fluid flow in the annulus, wellbore and/or reservoir. The three models may be solved simultaneously as a coupled system.

The production control unit 120 may take the form of an entirely hardware embodiment, an entirely software embodiment (including firmware, resident software, micro-code, etc.) or an embodiment combining software and hardware aspects. Embodiments may take the form of a computer program embodied in any medium having computer usable program code embodied in the medium. The embodiments may be provided as a computer program product, or software, that may include a machine-readable medium having stored thereon instructions, which may be used to program a computer system (or other electronic device(s)) to perform a process. A machine readable medium includes any mechanism for storing or transmitting information in a form (such as, software, processing application) readable by a machine (such as a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. Embodiments may further be embodied in an electrical, optical, acoustical or other form of propagated signal (e.g., carrier waves, infrared signals, digital signals, etc.), or wireline, wireless, or other communications medium. Further, it should be appreciated that the embodiments may take the form of hand calculations, and/or operator comparisons. To this end, the operator and/or engineer(s) may receive, manipulate, catalog and store the data from the system 102 in order to perform tasks depicted in the production control unit 120.

The production control unit 120 may include a storage device 502, a reservoir data unit 504, a reservoir model unit 506, a production path unit 508, a fluid flow unit 510, a production optimizer unit 512, a historical data unit 514, an analyzer unit 516, and a transceiver unit 518. The storage device 502 may be any conventional database or other storage device capable of storing data associated with the system 102, shown in FIG. 1. Such data may include, for example, historical data, pre-drilling data, base models, drilling data, completions data, production data and the like. The analyzer unit 516 may be any conventional device, or system, for performing calculations, derivations, predictions, analysis, and interpolation, such as those described herein. The transceiver unit 518 may be any conventional communication device capable of passing signals (e.g., power, communication) to and from the production control unit 120. The reservoir data unit 504, the reservoir model unit 506, the production path unit 508, the fluid flow unit 510, the production optimizer unit 512, and the historical data unit 514 may be used to receive, collect and catalog data and/or to generate outputs as will be described further below.

The reservoir data unit 504 may obtain, manipulate, catalog, classify and quantify data about the reservoir 105 (as shown in FIG. 1). The reservoir data may be obtained prior to drilling, during drilling, after drilling, during completions operations, and/or during the production life of the wellbore 105. The reservoir data may be sent to the production control unit 120 from multiple sources, such as from well logging, well testing, production history of neighboring wells, operator knowledge of the area, seismic data, pressure data, temperature data, flow data, and the like. The reservoir data may be obtained from any suitable device, tool, or personnel, about the wellsite 100 such as the logging tool 108, the seismic wave inducing tool 110, the one or more receivers 112, the one or more offsite communication devices 128, (as shown in FIG. 1), the sensor 406 (as shown in FIGS. 4A and 4B), and the like. The reservoir data may any number of reservoir 105 parameters, such as reservoir porosity, permeability, vertical permeability, lateral permeability, pressure, saturation, fluid front location, length of current and future open intervals of the horizontal portion 104 of the wellbore 103, and the like. Once the reservoir data has been cataloged and/or parameterized by the reservoir data unit 504, a reservoir model may be created.

The reservoir model unit 506 may use the data collected by the reservoir data unit 504 to build a model of the reservoir 105. The reservoir model may account for uncertainty in the subsurface geology. The reservoir model may account for multiphase effects and reservoir heterogeneity in the presence of the subsurface uncertainty. The reservoir model may further describe the lateral heterogeneity and pressure/production behavior of the system 102 (as shown in FIG. 1). The reservoir model may determine the location of the fluid front as a function of time and/or as a function of the reservoir heterogeneity. The reservoir model may determine properties for each of the reservoir permeability zones 130 such as porosity, horizontal permeability and vertical permeability. The properties may be described in terms of a probability distribution function (PDF). The correlation between porosity and permeability may be considered by a joint PDF. A semi-analytic simulator, or Monte Carlo simulation, may be used to create the multiple realization of the reservoir model.

The reservoir model generated by the reservoir model unit 506 may be a semi-analytic simulator, or Monte Carlo simulation, for characterizing dynamic flow behavior within the reservoir 105. The semi-analytic simulator may describe the pressure and the velocity field of the reservoir 105 as a function of spatial position [x, y, z] in the reservoir 105 and time t. The reservoir model may also predict the position of the vertically advancing fluid front 126 as a function of lateral spatial position x, y and time t. The semi-analytical simulator may quickly converge without gridding challenges or numerical instabilities found in multi-million cell finite difference reservoir models. Thus, when the reservoir model is the semi-analytical simulator the reservoir model may determine a solution quickly and/or in substantially real time in order to optimize the production of the reservoir.

The semi-analytic simulator may consider, for example, a continuum of volume $(a_{j+1}-a_j)$ bd for the reservoir permeability zones 130 (as shown in FIG. 2). The coordinates of the continuum are:

$[(a_j, 0,0), (a_j, b, 0), (a_{j+1}, 0,0), (a_{j+1}, b, 0), (a_j, 0, d), (a_{j+1}, b, d), (a_{j+1}, 0, d), (a_{j+1}, b, d)]$.

The continuum may commence at time t=0. A fluid rate of $\tilde{q}_l(t)$ may enter the continuum at z=0 over the area, $(a_{j+1}-a_j)$ b and may displace the insitu fluids such that a uniform, immobile fluid saturation exists behind the advancing fluid front 126. The resulting pressure disturbance may be left to diffuse through the homogeneous porous medium.

The initial and boundary conditions of the moving front in a rectangularly subdivided continuum of volume $(a_N-a_0)$ bd. The continuum is subdivided along the x axis, $a_j \le x \le a_{j+1}$, $\forall j=$ $$0, 1, \ldots, N-1. \text{ At } x = a_0: \quad \text{(Equation 1)}$$

$$\frac{\partial p(a_0, y, z, t)}{\partial x} = -\left(\frac{\mu}{k_x}\right)\psi_{0yz}(y, z, t)$$

$$\text{At } x = a_N:$$

$$\frac{\partial p(a_N, y, z, t)}{\partial x} = -\left(\frac{\mu}{k_x}\right)\psi_{Nyz}(y, z, t).$$

$\psi_{0yz}(y, z, t)$ and $\psi_{Nyz}(y, z, t)$ are arbitrary functions of y, z and t.

At the static interface $x=a_j$, $\forall j=1, 2, \ldots N-1$:

$$\psi_j(y, z, t) = -\left(\frac{k_x}{\mu}\right)_j\left(\frac{\partial p_j(a_j, y, z, t)}{\partial x}\right) = -\left(\frac{k_x}{\mu}\right)_{j-1}\left(\frac{\partial p_{j-1}(a_j, y, z, t)}{\partial x}\right) \quad \text{(Equation 2)}$$

and $$\tilde{\lambda}_j\psi_j(y, z, t) = \{p_{j-1}(a_j, y, z, t) - p_j(a_j, y, z, t)\}. \quad \text{(Equation 3)}$$

$$\text{At } y = 0:$$

$$\frac{\partial p(x, 0, z, t)}{\partial y} = -\left(\frac{\mu}{k_y}\right)\psi_{x0z}(x, z, t)$$

$$\text{and at } y = b:$$

$$\frac{\partial p(x, b, z, t)}{\partial y} = -\left(\frac{\mu}{k_y}\right)\psi_{xbz}(x, z, t).$$

$\psi_{x0z}(x, z, t)$ and $\psi_{xbz}(x, z, t)$ are arbitrary functions of x, z and t.

At z=0:

$p_j(x, y, 0, t)=\psi_{0j}(t)$ and at z=d:

$p_j(x, y, d, t)=\psi_{dj}(t)$.

$\psi_{0j}(t)$ and $\psi_{dj}(t)$ are arbitrary functions of t only.

At $z=z_{fj}(x, y, t)$, $0<z_{fj}(x, y, t)<d$, the moving boundary is:

$$\frac{\partial p_j(x, y, z_{fj}, t)}{\partial y} = -\left(\frac{\mu}{k_z}\right)\psi_{fj}(x, y, t).$$

Point source at $(x_{0j}, y_{0j}, z_{0j})$, $a_j \le x_{0j} \le a_{j+1}$, $0 \le y_{0j} \le b$ and $z_{fj}(x, y, t) \le z_{0j} \le d$.

The initial pressure $p_j(x, y, z, 0)=\phi_j(x, y, z)$.

The semi-analytical simulator may use the differential equation for pressure diffusion may be given by:

$$\frac{\partial p_j}{\partial t} = \eta_{xj}\frac{\partial^2 p_j}{\partial x^2} + \eta_{yj}\frac{\partial^2 p_j}{\partial y^2} + \eta_{zj}\frac{\partial^2 p_j}{\partial z^2} \quad \text{(Equation 4)}$$

where:

$$\eta_{lj} = \left(\frac{k_l}{\phi c_t \mu}\right)_j, \; l = x, y \text{ or } z. \quad \text{(Equation 5)}$$

$k_l$ is the effective permeability. For the invaded zone:

$$k_{lj}=(k_{al}k_{rw}|_{1-s_{or}})_j \quad \text{(Equation 6)}$$

and for the un-invaded zone:

$$k_{lj}=(k_{al}k_{ro}|_{s_{wi}})_j$$

$k_{al}$ may be the absolute permeability. $k_{rw}|_{1-s_{or}}$ and $k_{ro}|_{s_{wi}}$ may be relative permeabilities of water and oil at saturations $1-S_{or}$ and $S_{wi}$ respectively. $S_{wi}$ may be the initial fluid saturation and $S_{or}$ may be the irreducible oil saturation.

At the moving interface, $$p\{x, y, z_{fj}(t), t\}_i = p\{x, y, z_{fj}(t), t\}_u \quad \text{(Equation 7)}$$

and $$\left[\frac{\partial p\{x, y, z_{fj}(t), t\}}{\partial z}\right]_i \left(\frac{\mu}{k_z}\right)_i = \left[\frac{\partial p\{x, y, z_{fj}(t), t\}}{\partial z}\right]_u \left(\frac{\mu}{k_z}\right)_u$$

Here, i and u denote the invaded and the un-invaded regions.

The semi-analytic simulator may use the following solution to determine the properties of the invaded region and the un-invaded region.

The Invaded Region: $0 \le z \le z_{fj}(x, y, t)$

For early times, when the fluid front is still close to the wellbore, pressure in the invaded region is given by the lowest order solution $$p_{ji} = \frac{8}{(a_{j+1}-a_j)b}\sum_{n=0}^{\infty} \ni_n \cos(\xi_{nj}x)\sum_{m=0}^{\infty}\frac{\ni_m \cos(\xi_m y)}{\bar{\bar{z}}_{fj}(\xi_{nj}, \xi_m, t)}\sum_{l=1}^{\infty}\sin(\xi_{lj}z)\int_0^t e^{-[v_{ll}(t)-v_{ll}(\tau)]}B_j(\xi_{nj}, \xi_m, \xi_{lj}, \tau)d\tau + \frac{8}{(a_{j+1}-a_j)b}\sum_{n=0}^{\infty}\ni_n \cos(\xi_{nj}x)\sum_{m=0}^{\infty}\frac{\ni_m \cos(\xi_m y)}{\bar{\bar{z}}_{fj}(\xi_{nj}, \xi_m, t)}\sum_{l=1}^{\infty}\sin(\xi_{lj}z)\bar{\bar{\varphi}}_j(\xi_{nj}, \xi_m, \xi_{lj})e^{-v_{ll}(t)} \quad \text{(Equation 8)}$$

where $p_{ji}=p_{ji}(x, y, z, t)$. The set of eigenvalues $\xi_{lj}$ are the positive roots of $\cos\{\xi_{lj}\bar{\bar{z}}_{fj}(\xi_{nj}, \xi_m, t)\}=0$, which are $$\xi_{lj} = \frac{(2l-1)\pi}{2\bar{\bar{z}}_{fj}(\xi_{nj}, \xi_m, t)}, \; l = 1, 2, \ldots \quad \text{(Equation 9)}$$

The eigenvalues $\xi_{nj}$ and $\xi_m$ are given by $$\xi_{nj} = \frac{n\pi}{(a_{j+1}-a_j)}, \; n = 0, 1, 2, \ldots$$

and $$\xi_m = \frac{m\pi}{b}, \; m = 0, 1, 2, \ldots$$

respectively.

$$v_{ll}(t) = \int_0^t \varpi_{ll}(\tau)d\tau \quad \text{(Equation 10)}$$

$$\varpi_{ll}(t) = \xi_{nj}^2\eta_{xj} + \xi_m^2\eta_{yj} + \xi_{lj}^2\eta_{zj} + \frac{1}{2\bar{\bar{z}}_{fj}(\xi_{nj}, \xi_m, t)}\frac{\partial\bar{\bar{z}}_{fj}(\xi_{nj}, \xi_m, t)}{\partial t} \quad \text{(Equation 11)}$$

The time derivative of the moving front, $$\frac{\partial\bar{\bar{z}}_{fj}(\xi_{nj}, \xi_m, t)}{\partial t},$$

is given by:

$$\frac{d\bar{\bar{z}}_{fj}(\xi_{nj}, \xi_m, t)}{dt} = \frac{\tilde{q}_j(t)\sigma_{nj}\sigma_m}{(a_{j+1}-a_j)b\phi_j(1-S_{or}-S_w)_j} - \int_0^{\bar{\bar{z}}_{fj}(\xi_{nj},\xi_m,t)}\{(-1)^n\bar{\psi}_{j+1}(\xi_m, z, t) - \bar{\psi}_j(\xi_m, z, t) + \xi_{nj}\bar{\bar{q}}_{xsj}(\xi_{nj}, \xi_m, z, t)\}dz - \int_0^{\bar{\bar{z}}_{fj}(\xi_{nj},\xi_m,t)}\{(-1)^m\bar{\psi}_{xbz}(\xi_{nj}, z, t) - \bar{\psi}_{x0z}(\xi_{nj}, z, t) + \xi_m\bar{\bar{q}}_{ysj}(\xi_{nj}, \xi_m, z, t)\}dz \quad \text{(Equation 12)}$$

and the advancing fluid, in Fourier transformed space, is given by:

$$\bar{\bar{z}}_{fj}(\xi_{nj}, \xi_m, t) = \frac{\sigma_{nj}\sigma_m\int_0^t\tilde{q}_j(\tau)d\tau}{(a_{j+1}-a_j)b\phi_j(1-S_{or}-S_w)_j} - \int_0^t\int_0^{\bar{\bar{z}}_{fj}(\xi_{nj},\xi_m,t)}\{(-1)^n\bar{\psi}_{j+1}(\xi_m, z, \tau) - \bar{\psi}_j(\xi_m, z, \tau) + \xi_{nj}\bar{\bar{q}}_{xsj}(\xi_{nj}, \xi_m, z, \tau)\}dzd\tau - \int_0^t\int_0^{\bar{\bar{z}}_{fj}(\xi_{nj},\xi_m,t)}\{(-1)^m\bar{\psi}_{xbz}(\xi_{nj}, z, \tau) - \bar{\psi}_{x0z}(\xi_{nj}, z, \tau) + \xi_m\bar{\bar{q}}_{ysj}(\xi_{nj}, \xi_m, z, \tau)\}dzd\tau \quad \text{(Equation 13)}$$

Where $\tilde{q}_j(t)$ is the rate at which the fluid is entering the oil column, $$\sigma_{nj} = \begin{cases} 0 & n \neq 0 \\ a_{j+1}-a_j & n = 0 \end{cases} \quad \text{(Equation 14)}$$

$$\sigma_m = \begin{cases} 0 & m \neq 0 \\ b & m = 0 \end{cases} \quad \text{(Equation 15)}$$

$$\bar{\bar{q}}_{xsj}(\xi_{nj}, \xi_m, z, t) = \int_0^b\int_0^{(a_{j+1}-a_j)} q_{xj}(x, y, z, t)\sin(\xi_{nj}x)\cos(\xi_m y)dxdy \quad \text{(Equation 16)}$$

$$\bar{\bar{q}}_{ysj}(\xi_{nj}, \xi_m, z, t) = \int_0^{(a_{j+1}-a_j)}\int_0^b q_{yj}(x, y, z, t)\sin(\xi_m y)\cos(\xi_{nj}x)dydx \quad \text{(Equation 17)}$$

-continued $$\bar{\psi}_j = \int_0^b \psi_j(y, z, t)\cos(\xi_m y)\,dy \quad \text{(Equation 18)}$$

$$\bar{\psi}_{j+1} = \int_0^b \psi_{j+1}(y, z, t)\cos(\xi_m y)\,dy \quad \text{(Equation 19)}$$

$$\bar{\psi}_{xbz} = \int_0^{(a_{j+1}-a_j)} \psi_{xbz}(x, z, t)\cos(\xi_{nj} x)\,dx \quad \text{(Equation 20)}$$

$$\bar{\psi}_{x0z} = \int_0^{(a_{j+1}-a_j)} \psi_{x0z}(x, z, t)\cos(\xi_{nj} x)\,dx \quad \text{(Equation 21)}$$

$$\bar{\bar{z}}_{fj}(\xi_{nj}, \xi_m, t) = \int_0^b \int_0^{(a_{j+1}-a_j)} z_{fj}(x, y, t)\cos(\xi_{nj} x)\cos(\xi_m y)\,dx\,dy \quad \text{(Equation 22)}$$

and $$\bar{\bar{q}}_{zj}(\xi_{nj}, \xi_m, \bar{\bar{z}}_{fj}, t) = \frac{d\bar{\bar{z}}_{fj}(\xi_{nj}, \xi_m, t)}{dt} \quad \text{(Equation 23)}$$

We have assumed that the fluid velocity at z=0 is independent of x and y, that is, $$\bar{\bar{q}}_{zj}(\xi_{nj}, \xi_m, 0, t) = \frac{\tilde{q}_j(t)\sigma_{nj}\sigma_m}{(a_{j+1} - a_j)b\phi_j(1 - S_{or} - S_w)_j},$$

is a function of time only. The rate at which the fluid entering the oil column, $\tilde{q}_j(t)$, at z=0 is not known a priori.

$$B_j(\xi_{nj}, \xi_m, \xi_{lj}, t) = \frac{1}{\phi c_t}\Big\{(-1)^{n+1}\bar{\bar{\psi}}_{j+1}(\xi_m, \xi_{lj}, t) + \bar{\bar{\psi}}_j(\xi_m, \xi_{lj}, t) + (-1)^{m+1}\bar{\bar{\psi}}_{xbz}(\xi_{nj}, \xi_{lj}, t) + \psi x0z\xi nj, \xi lj, t + \xi lj\eta zj\psi 0t + -1l\psi ft\phi ct\sigma nj\sigma m + -1l + 1pn, m, zfj\xi nj, \xi m, t\partial zfj\xi nj, \xi m, t\partial t \quad \text{(Equation 24)}$$

where $$\bar{\bar{\psi}}_j(\xi_m, \xi_{lj}, t) = \int_0^{\bar{\bar{z}}_{fj}(\xi_{nj}, \xi_m, t)} \int_0^b \psi_j(y, z, t)\cos(\xi_m y)\kappa_j(z, \xi_{lj})\,dy\,dz \quad \text{(Equation 25)}$$

$$\bar{\bar{\psi}}_{j+1}(\xi_m, \xi_{lj}, t) = \int_0^{\bar{\bar{z}}_{fj}(\xi_{nj}, \xi_m, t)} \int_0^b \psi_{j+1}(y, z, t)\cos(\xi_m y)\kappa_j(z, \xi_{lj})\,dy\,dz \quad \text{(Equation 26)}$$

$$\bar{\bar{\psi}}_{x0z}(\xi_{nj}, \xi_{lj}, t) = \int_0^{\bar{\bar{z}}_{fj}(\xi_{nj}, \xi_m, t)} \int_0^{(a_{j+1}-a_j)} \psi_{x0z}(x, z, t)\cos(\xi_{nj} x)\kappa_j(z, \xi_{lj})\,dx\,dz \quad \text{(Equation 27)}$$

and $$\bar{\bar{\psi}}_{xbz}(\xi_{nj}, \xi_{lj}, t) = \int_0^{\bar{\bar{z}}_{fj}(\xi_{nj}, \xi_m, t)} \int_0^{(a_{j+1}-a_j)} \psi_{xbz}(x, z, t)\cos(\xi_{nj} x)\kappa_j(z, \xi_{lj})\,dx\,dz \quad \text{(Equation 28)}$$

If the initial condition, $\phi_j(x, y, z)=p_{lj}$ is a constant, equation 8 reduces to $$p_{ji} = \frac{8}{(a_{j+1} - a_j)b}\sum_{n=0}^{\infty} \ni_n \cos(\xi_{nj} x)\sum_{m=0}^{\infty} \frac{\ni_m \cos(\xi_m y)}{\bar{\bar{z}}_{fj}(\xi_{nj}, \xi_m, t)}\sum_{l=1}^{\infty} \sin(\xi_{lj} z) \int_0^t e^{-\{v_{ll}(t) - v_{ll}(\tau)\}} B_j(\xi_{nj}, \xi_m, \xi_{lj}, \tau)\,d\tau + \frac{4p_{lj}}{\pi}\sum_{l=1}^{\infty} \frac{\sin(\xi_{lj} z)}{(2l-1)} e^{-v_{ll}(t)} \quad \text{(Equation 29)}$$

For late times, as the fluid front moves away from the wellbore, a good iterative approximation can be made. The system to be solved is given by:

$$\frac{\partial \bar{\bar{p}}_{ji}(\xi_{nj}, \xi_m, \xi_{lj}, t)}{\partial t} + \varpi_{ll}(t)\bar{\bar{p}}_{ji}(\xi_{nj}, \xi_m, \xi_{lj}, t) = B_j(\xi_{nj}, \xi_m, \xi_{lj}, t) + C_{odt-1}(\xi_{nj}, \xi_m, \xi_{lj}, t) \quad \text{(Equation 30)}$$

$\iota = 1, 2, \ldots$ where $$C_{odt-1}(\xi_{nj}, \xi_m, \xi_{lj}, t) = \begin{cases} 0 & \iota = 1 \\ \sum_{k=1}^{\infty} \varpi_{kl}(t)\bar{p}_{ii-1}(\xi_{nj}, \xi_m, \xi_{kl}) & k \neq l, \end{cases} \quad \text{(Equation 31)}$$

$\iota = 2, 3, \ldots$ $B_j(\xi_{nj}, \xi_m, \xi_{lj}, t)$ is given by equation 24 and t is the iteration counter. The general solution of equation 11 may be explicitly solved to give $$\bar{\bar{p}}_{ji} = \bar{\bar{\varphi}}_{ji}(\xi_{nj}, \xi_m, \xi_{lj}, t)e^{-v_{ll}(t)} + \int_0^t e^{-\{v_{ll}(t) - v_{ll}(\tau)\}}\{B_{ji}(\xi_{nj}, \xi_m, \xi_{lj}, \tau) + C_{odt-1}(\xi_{nj}, \xi_m, \xi_{lj}, t)\}\,d\tau \quad \text{(Equation 32)}$$

Hence, for the invaded region, the solution to be used in the iterative scheme may be written as:

$$p_{iji} = \frac{8}{(a_{j+1} - a_j)b}\sum_{n=0}^{\infty} \ni_n \cos(\xi_{nj} x)\sum_{m=0}^{\infty} \frac{\ni_m \cos(\xi_m y)}{\bar{\bar{z}}_{fj}(\xi_{nj}, \xi_m, t)}\sum_{l=1}^{\infty} \sin(\xi_{lj} z)\int_0^t e^{-\{v_{ll}(t) - v_{ll}(\tau)\}}\{B_{ji}(\xi_{nj}, \xi_m, \xi_{lj}, \tau) + C_{odt-1}(\xi_{nj}, \xi_m, \xi_{lj}, t)\}\,d\tau + \frac{4p_{lj}}{\pi}\sum_{l=1}^{\infty} \frac{\sin(\xi_{lj} z)}{(2l-1)} e^{-v_{ll}(t)} \quad \text{(Equation 33)}$$

Where $p_{iji}=p_{iji}(x, y, z, t)$. To start the iteration at t=1, pressure may be obtained from the lowest order solution.

Deploying the interfacial boundary conditions at $x=a_j$, results is three distinct integral equations:

$$0 \le z \le \begin{cases} z_{fj}(x, y, t) & z_{fj}(x, y, t) < z_{fj-1}(x, y, t) \\ z_{fj-1}(x, y, t) & z_{fj-1}(x, y, t) < z_{fj}(x, y, t) \end{cases} \quad \text{(Equation 34)}$$

$$\check{\lambda}_j \psi_j(y, z, t) = \{p_{j-1i}(a_j, y, z, t) - p_{ji}(a_j, y, z, t)\}$$

$$z_{fj-1}(x, y, t) < z < z_{fj}(x, y, t) \quad \text{(Equation 35)}$$

$$\check{\lambda}_j \psi_j(y, z, t) = \{p_{j-1u}(a_j, y, z, t) - p_{ji}(a_j, y, z, t)\}$$

If $z_{fj}(x, y, t)<z_{fj-1}(x, y, t)$, equation 35 should be multiplied by the negative sign.

$$\left.\begin{matrix} z_{fj-1}(x, y, t) < z_{fj}(x, y, t) & z_{fj}(x, y, t) \\ z_{fj}(x, y, t) < z_{fj-1}(x, y, t) & z_{fj-1}(x, y, t) \end{matrix}\right\} \le z \le d \quad \text{(Equation 36)}$$

$$\check{\lambda}_j \psi_j(y, z, t) = \{p_{j-1u}(a_j, y, z, t) - p_{ju}(a_j, y, z, t)\}$$

The un-invaded region: $z_{fj}(x, y, t)\le z\le d$

The differential equation for pressure diffusion in this region is:

$$\frac{\partial p_j}{\partial t} = \eta_{xj}\frac{\partial^2 p_j}{\partial x^2} + \eta_{yj}\frac{\partial^2 p_j}{\partial y^2} + \eta_{zj}\frac{\partial^2 p_j}{\partial z^2} + \frac{q_j(t)}{(\phi c_t)_j}\delta(x - x_{0j})\delta(y - y_{0j})\delta(z - z_{0j}) \quad \text{(Equation 37)}$$

A quantity $q_j(t)$ of fluid is continuously injected at $(x_{0j}, y_{0j}, z_{0j})$, $a_j\le x_{0j}\le a_{j+1}$, $0\le y_{0j}\le b$, $z_{fj}(x, y, t)\le z_{0j}\le d$.

The lowest order for a horizontal line source of length $(x_{02j}-x_{01j})$ in time domain is:

$$p_{ju} = \frac{8}{(a_{j+1} - a_j)b}\sum_{n=0}^{\infty} \ni_n \cos(\xi_{nj}x)\sum_{m=0}^{\infty}\frac{\ni_m \cos(\xi_m y)}{\{d - \bar{\bar{z}}_{fj}(\xi_{nj}, \xi_m, t)\}} \times \sum_{l=1}^{\infty}\cos\{\xi_{lj}(z - \bar{\bar{z}}_{fj}(\xi_{nj}, \xi_m, t))\}\bar{\bar{\varphi}}_j(\xi_{nj}, \xi_m, \xi_{lj})e^{-v_{lu}(t)} + \frac{8}{(a_{j+1} - a_j)b}\sum_{n=0}^{\infty} \ni_n \cos(\xi_{nj}x) \sum_{m=0}^{\infty}\frac{\ni_m \cos(\xi_m y)}{\{d - \bar{\bar{z}}_{fj}(\xi_{nj}, \xi_m, t)\}}\sum_{l=1}^{\infty}\cos\{\xi_{lj}(z - \bar{\bar{z}}_{fj}(\xi_{nj}, \xi_m, t))\} \times \int_0^t e^{-\{v_{lu}(t)-v_{lu}(\tau)\}}D_j(\xi_{nj}, \xi_m, \xi_{lj}, \tau)d\tau \quad \text{(Equation 38)}$$

where $p_{ju}=p_{ju}(x, y, z-z_{fj}(x, y, t), t)$. The set of eigenvalues $\xi_{lj}$ are the positive root of $\cos\{\xi_{lj}(d-\bar{\bar{z}}_{fj}(\xi_{nj}, \xi_m, t))\}=0$, which are $$\xi_{lj} = \frac{(2l - 1)\pi}{2\{d - \bar{\bar{z}}_{fj}(\xi_{nj}, \xi_m, t)\}}, \; l = 1, 2, \ldots$$

-continued $$\bar{\bar{\varphi}}_j(\xi_{nj}, \xi_m, \xi_{lj}) = \int_0^{d-\bar{\bar{z}}_{fj}(\xi_{nj},\xi_m,t)}\int_0^b\int_0^{a_{j+1}-a_j}\varphi_j(x, y, +\bar{\bar{z}}_{fj}(\xi_{nj}, \xi_m, t)) \cos(\xi_{nj}x)\cos(\xi_m y)\cos(\xi_{lj}z)\,dx\,dy\,dz, \quad \text{(Equation 39)}$$

$$v_{lu}(t) = \int_o^t \bar{\omega}_{lu}(\tau)\,d\tau \quad \text{(Equation 40)}$$

$$\bar{\omega}_{lu}(t) = \xi_{nj}^2\eta_{xj} + \xi_m^2\eta_{yj} + \xi_{lj}^2\eta_{zj} + \frac{1}{2\{d - \bar{\bar{z}}_{fj}(\xi_{nj}, \xi_m, t)\}}\frac{\partial\bar{\bar{z}}_{fj}(\xi_{nj}, \xi_m, t)}{\partial t} \quad \text{(Equation 41)}$$

$$\bar{\bar{z}}_{fj}(\xi_{nj}, \xi_m, t) \text{ and } \frac{\partial\bar{\bar{z}}_{fj}(\xi_{nj}, \xi_m, t)}{\partial t}$$

are given by equations 13 and 12.

$$D_j(\xi_{nj}, \xi_m, \xi_{lj}, t) = \frac{1}{\phi c_t}\Big\{(-1)^{n+1}\bar{\bar{\psi}}_{j+1}(\xi_m, \xi_{lj}, t) + \bar{\bar{\psi}}_j(\xi_m, \xi_{lj}, t) + (-1)^{m+1}\bar{\bar{\psi}}_{xbz}(\xi_{nj}, \xi_{lj}, t) + \bar{\bar{\psi}}_{x0z}(\xi_{nj}, \xi_{lj}, t)\Big\} + \Big\{\xi_{lj}\eta_{zj}\psi_0(t) + (-1)^t\frac{\psi_f(t)}{\phi c_t}\Big\}\sigma_{nj}\sigma_m + \frac{q_j(t)\cos\{\xi_{lj}(z_0 - z_{fj})\}\{\sin(\xi_{nj}x_{02}) - \sin(\xi_{nj}x_{01})\}\cos(\xi_m y_0)}{\phi c_t\xi_{nj}} \quad \text{(Equation 42)}$$

where $$\bar{\bar{\psi}}_{x0z}(\xi_{nj}, \xi_{lj}, t) = \int_0^{d-\bar{\bar{z}}_{fj}(\xi_{nj},\xi_m,t)}\int_0^{(a_{j+1}-a_j)}\psi_{x0z}(x, z, t)\cos(\xi_{nj}x)\cos(\xi_{lj}z)\,dx\,dz, \quad \text{(Equation 43)}$$

$$\bar{\bar{\psi}}_{xbz}(\xi_{nj}, \xi_{lj}, t) = \int_0^{d-\bar{\bar{z}}_{fj}(\xi_{nj},\xi_m,t)}\int_0^{(a_{j+1}-a_j)}\psi_{xbz}(x, z, t)\cos(\xi_{nj}x)\cos(\xi_{lj}z)\,dx\,dz, \quad \text{(Equation 44)}$$

$$\bar{\bar{\psi}}_j(\xi_m, \xi_{lj}, t) = \int_0^{d-\bar{\bar{z}}_{fj}(\xi_{nj},\xi_m,t)}\int_0^b\psi_j(y, z, t)\cos(\xi_m y)\cos(\xi_{lj}z)\,dy\,dz, \quad \text{(Equation 45)}$$

and $$\bar{\bar{\psi}}_{j+1}(\xi_m, \xi_{lj}, t) = \int_0^{d-\bar{\bar{z}}_{fj}(\xi_{nj},\xi_m,t)}\int_0^b\psi_{j+1}(y, z, t)\cos(\xi_m y)\cos(\xi_{lj}z)\,dy\,dz. \quad \text{(Equation 46)}$$

The subscript u denotes the un-invaded region $\bar{\bar{z}}_{fj}(\xi_{nj}, \xi_m, t)\le z\le d$ and $p_{ju}=p_{ju}(x, y, z-z_{fj}(x, y, t), t)$.

If the initial condition, $\phi_j(x, y, z)=p_{lj}$, equation 38 reduces to $$p_{ju} = \frac{8}{(a_{j+1}-a_j)b}\sum_{n=0}^{\infty} \ni_n \cos(\xi_{nj}x)\sum_{m=0}^{\infty}\frac{\ni_m \cos(\xi_m y)}{\{d-\bar{\bar{z}}_{fj}(\xi_{nj},\xi_m,t)\}}\times \sum_{l=1}^{\infty}\cos\{\xi_{lj}(z-\bar{\bar{z}}_{fj}(\xi_{nj},\xi_m,t))\} \int_o^t e^{-[v_u(t)-v_u(\tau)]}D_j(\xi_{nj},\xi_m,\xi_{lj},\tau)\,d\tau + \frac{4p_{lj}}{\pi}\sum_{l=1}^{\infty}\frac{(-1)^{l+1}e^{-v_u(t)}\cos\{\xi_{lj}(z-\bar{\bar{z}}_{fj}(\xi_{nj},\xi_m,t))\}}{(2l-1)} \quad \text{(Equation 47)}$$

For late times when the fluid front moves away from the wellbore, a good iterative approximation can be made. The system to be solved for this case is given by:

$$\frac{\partial \bar{\bar{p}}_{ji}(\xi_{nj},\xi_m,\xi_{lj},t)}{\partial t} + \bar{\omega}_u(t)\bar{\bar{p}}_{ji}(\xi_{nj},\xi_m,\xi_{lj},t) = D_j(\xi_{nj},\xi_m,\xi_{lj},t) + C_{odi-1}(\xi_{nj},\xi_m,\xi_{lj},t) \quad i=1,2,\ldots \quad \text{(Equation 48)}$$

where $$C_{odi-1}(\xi_{nj},\xi_m,\xi_{lj},t) = \begin{cases} 0 & i=1 \\ \sum_{k=1}^{\infty}\bar{\omega}_{kl}(t)\bar{p}_{ui-1}(\xi_{nj},\xi_m,\xi_{kl}) & k\neq l,\ i=2,3,\ldots \end{cases} \quad \text{(Equation 49)}$$

$D_j(\xi_{nj}, \xi_m, \xi_{lj}, t)$ is given by equation 42 and t is the iteration counter. The general solution of equation 48 may be explicitly solved to give $$\bar{\bar{p}}_{ji} = \bar{\bar{\varphi}}_{ji}(\xi_{nj},\xi_m,\xi_{lj},t)e^{-v_u(t)} + \int_0^t e^{-[v_u(t)-v_u(\tau)]}\{D_{ji}(\xi_{nj},\xi_m,\xi_{lj},\tau) + C_{odi-1}(\xi_{nj},\xi_m,\xi_{lj},t)\}\,d\tau \quad \text{(Equation 50)}$$

Hence, for the un-invaded region, the solution to be used in the iterative scheme may be written as:

$$p_{uji} = \frac{8}{(a_{j+1}-a_j)b}\sum_{n=0}^{\infty} \ni_n \cos(\xi_{nj}x)\sum_{m=0}^{\infty}\frac{\ni_m \cos(\xi_m y)}{\{d-\bar{\bar{z}}_{fj}(\xi_{nj},\xi_m,t)\}}\times \sum_{l=1}^{\infty}\cos\{\xi_{lj}(z-\bar{\bar{z}}_{fj}(\xi_{nj},\xi_m,t))\} \int_0^t e^{-[v_u(t)-v_u(\tau)]}\{D_{ji}(\xi_{nj},\xi_m,\xi_{lj},\tau) + C_{odi-1}(\xi_{nj},\xi_m,\xi_{lj},t)\}\,d\tau + \quad \text{(Equation 51)}$$

-continued $$\frac{4p_{lj}}{\pi}\sum_{l=1}^{\infty}\frac{(-1)^{l+1}e^{-v_u(t)}\cos\{\xi_{lj}(z-\bar{\bar{z}}_{fj}(\xi_{nj},\xi_m,t))\}}{(2l-1)}$$

Where $p_{uji}=p_{uji}(x, y, z-z_{fj}(x, y, t), t)$. To start the iteration at t=1, pressure may be obtained from the lowest order solution. Deploying the interfacial boundary conditions at $x=a_j$ results in three distinct integral equations:

$$0 \le z \le \begin{cases} z_{fj}(x,y,t_0) & z_{fj}(x,y,t_0) < z_{fj-1}(x,y,t_0) \\ z_{fj-1}(x,y,t_0) & z_{fj-1}(x,y,t_0) < z_{fj}(x,y,t_0) \end{cases} \quad \text{(Equation 52)}$$

$$\breve{\lambda}_j\psi_j(y,z,t) = \{p_{j-1i}(a_j,y,z,t) - p_{ji}(a_j,y,z,t)\}$$

$$z_{fj-1}(x,y,t_0) < z < z_{fj}(x,y,t_0) \quad \text{(Equation 53)}$$

$$\breve{\lambda}_j\psi_j(y,z,t) = \{p_{j-1u}(a_j,y,z,t) - p_{ji}(a_j,y,z,t)\}$$

If $z_{fj}(x, y, t_0)<z_{fj-1}(x, y, t_0)$, equation 53 should be multiplied by the negative sign.

$$\left.\begin{matrix} z_{fj-1}(x,y,t_0) < z_{fj}(x,y,t_0) & z_{fj}(x,y,t_0) \\ z_{fj}(x,y,t_0) < z_{fj-1}(x,y,t_0) & z_{fj-1}(x,y,t_0) \end{matrix}\right\} \le z \le d \quad \text{(Equation 54)}$$

$$\breve{\lambda}_j\psi_j(y,z,t) = \{p_{j-1u}(a_j,y,z,t) - p_{ju}(a_j,y,z,t)\}$$

At the interface $z=z_{fj}(x, y, t)$, matching the pressure solutions of the invaded and un-invaded regions, produce two integral equations with two unknowns: the pressure and the flux. The pressure and flux at the interface, deduced from these equations, may then be used in the general solutions to obtain pressure as a function of x, y, z and t.

The reservoir model unit 506 is described herein as creating a reservoir model based on a semi-analytic simulator. There may be any number of methods used to create the reservoir model such as a multi-million cell finite difference reservoir model, and the like. Therefore, any suitable reservoir model may be used so long as the reservoir model generates multiple realizations of the reservoir 105.

The production path unit 508 may model a production path in the wellbore 105. The production path may be the installed equipment for producing the fluids from the wellbore 103 (as shown in FIG. 1) such as production tubing, the control devices 116, the annular flow controllers 132 and the like. The production path model may take into account pressure drop in the wellbore 105 due to sudden contractions and enlargements along the path of fluid flow through the wellbore 105, for example through the nozzles and/or valves in the wellbore. The production path model may determine the pressure drop by taking into account any number of parameters for the equipment to be installed into the wellbore 105. The production path model may analyze installed equipment, and/or predict the behavior of equipment that may be installed in the wellbore 105. For example, the production path model may determine fluid flow in the wellbore, and/or pressure properties in the wellbore 105 based on the type of control devices 116, the size of the nozzles 302, or orifice 404, the number of nozzles 302, or orifice 404, the type of screen 306, the size of the base pipe 304 and the like. The production path model may determine these parameters prior to drilling, during drilling, during completions, and/or during production. The production path model may be updated in order to optimize the production of the wellbore 105. The production path unit 508 may be used in conjunction with the production optimization unit 512 in order to determine the optimal wellbore design, as will be described in more detail below. Further, the production path unit 508 may model the production path based on data received from the production optimizer unit 512 as will be described in more detail below.

The production path model may model the heel-to-toe section, or horizontal portion 104 of the wellbore 103 (as shown in FIG. 1). The production path model may consist of the control devices 116, an annulus, and the annular flow controllers 132. The pressure drop across the ICD 300 may be given by:

$$\Delta p_d \approx \frac{8\rho\tilde{q}_j(x,t)}{(\pi C_d N)^2 d_p^4} \quad \text{(Equation 55)}$$

where N is the density of the orifices per unit length in the base pipe, $d_p$ is the diameter of the orifice, or nozzle, ρ is the fluid density, $\tilde{q}_j(x, t)$ is the average radial inflow fluid flux in the interval $(x_{02j}-x_{01j})$ and $C_d$ is the discharge coefficient which accounts for the pressure drop due to sudden enlargements and contractions in the fluid flow path. The discharge coefficient $C_d$ corresponding to various orifice sizes and Reynolds Numbers may be obtained from Green, D. and R. Perry (2007). *Perry's Chemical Engineer's Handbook*. McGraw-Hill Professional. The pressure drop along the wellbore 103 may be determined by solving the equations of continuity and momentum. An example of an analysis that may be used is given by Bachurst, J. R., J. H. Harker, J. M. Richardson, and J. M. Coulson (1999). *Chemical Engineering*. Oxford: A Butterworth-Heinemann. In this example, the pressure drop along the pipe line, for steady state fluid flow may be given by:

$$\frac{dp}{dx} = 2F_f\frac{\rho v^2}{d_I} \quad \text{(Equation 56)}$$

Where $$v = \frac{4}{\pi d_I^2}\int_0^{x_{02j}-x_{01j}} \tilde{q}(x,t)\,dx \quad \text{(Equation 57)}$$

$d_I$ is be the inner diameter of the wellbore 103, v is the axial fluid velocity and $F_f$ is the friction factor. The friction factor is $F_f$ may be a function of the Reynolds Number and may be obtained from the Green, D. and R. Perry (2007). *Perry's Chemical Engineer's Handbook*. McGraw-Hill Professional, turbulent and transition flow regimes. For sufficiently long horizontal wells the flow regime is lamina at the toe, turbulent at the heel and transition in-between. Equation 56 may be solved by a simple marching algorithm to give pressure in the pipe $p_p$. The pressure at the sand-face (surface of the wellbore) is:

$$p_s = p_p + \Delta p_d \quad \text{(Equation 58)}$$

Further, any suitable method may be used to produce the production path model.

The fluid flow unit 510 may produce a fluid flow model. The fluid flow model may model, for example, the fluid flow in the reservoir 105, the wellbore 103 and/or the interface between the reservoir 105 and the wellbore 103. The fluid flow in the reservoir 105 may be coupled with, or integrated with, the fluid flow in the wellbore 103 by the pressure and flux continuity conditions at the surface of the wellbore 103. These conditions may be measured using sensors 406 in the wellbore 103, and/or through calculations. For example, a sand-face pressure may be calculated by the reservoir model from equation 33 and may be matched with that computed in the heel-to-toe equation 58 found in the production path model in order to determine an interface pressure. Further, the flux continuity at the interface may be obtained by matching the reservoir flux from the reservoir model with the wellbore flux from the production path model. For example, the fluid flux per unit length in the interval $(x_{02j}-x_{01j})$ of the wellbore 103 may be defined in equation 42 of the reservoir model and may be given by:

$$q_j(t) = \frac{1}{(x_{02j}-x_{01j})}\int_0^{x_{02j}-x_{01j}} \tilde{q}_j(x,t)\,dx \quad \text{(Equation 59)}$$

The fluid flow unit 510 may produce the fluid flow model by simultaneously (or substantially simultaneously) solving, and/or determining, the conditions and/or equations governing fluid flow in the reservoir 105, the control devices 116 and/or the wellbore 103. The conditions of the fluid flow may be optimized by the production optimizer unit 512 in order to prevent the premature breakthrough of the unwanted fluids.

The production optimizer unit 512 may optimize the system 102 (as shown in FIG. 1) in order to maintain a substantially uniform advancing fluid front 126. The production optimizer 512 may collect data from the reservoir model unit 506, the production path unit 508 and the fluid flow unit 510 in order to optimize the objective function of the advancing fluid front 126. The production optimizer unit 512 may optimize the objective function at all phases of the life of the wellsite 100, for example prior to drilling, during drilling, during completions, and/or during the production. Based on the optimized objective function, the production optimizer unit 512 may produce a well plan that optimizes production of the reservoir 105 during the life of the wellsite 100.

Prior to drilling the production optimizer unit 512 may be used to determine an optimal wellbore design. Prior to drilling, the reservoir model may be constructed based on pre-drilling data such as seismic data, information from neighboring wells, and/or operator knowledge of the area. With the reservoir model constructed, an initial production path model may be constructed by estimating the optimal configuration of the type of control devices 116, the location of the control devices 116, the nozzle orifice sizes and location, the type of screens 306 used and the like. The estimated optimal configuration of the production path may use seed values that may trigger the optimization process and may be chosen randomly, or entered based on operator and/or engineering knowledge. The estimated optimal configuration and the initial reservoir model may be used to construct a preliminary fluid flow model.

The production optimizer unit 512 may then use, for example, the production model for the estimated optimal configuration, the initial reservoir model and/or the preliminary fluid flow model to optimize the wellbore 103 design and propose production path design for optimizing the objective function. For example, the semi-analytic simulator may be used to generate a larger number of realizations for optimizing the production path, and/or the wellbore 103. The realizations may take into account the probability distribution functions of the subsurface parameters. Each of the realizations together with a proposed control device 116 (ICD or FCV) configurations may then be re-run in the semi-analytic simulator to create a new optimized model. The new optimized model may incorporate any known method for optimizing the objective function. Thus, the first time the production optimizer unit 512 is used prior to drilling, the proposed production path may be used with the seed values for the production path. In subsequent iterations, the production optimizer unit 512 may use the new optimized model in order to converge the model and optimize the objective function.

The production optimizer unit 512 may then test for convergence criteria in order to optimize the objective function. For example, the objective may be to keep the shape of the advancing fluid front 126 as flat as possible. In this example, the objective function would be a value that would diminish the levels of fluid rising through the vertical segments established by the probability distribution functions, or the reservoir permeability zones 130A-130I (as shown in FIG. 1). Thus, the production optimizer unit 512 may optimize the objective function Θ as follows:

$$\Theta=\Sigma_{j=1}^{M}\{r_{fj}(x,y,t)-r_{fj-1}(x,y,t)\}^2 \quad \text{(Equation 60)}$$

Thus, the objective function Θ may be minimized by varying the control device parameters (as described above). Maintaining a substantially flat advancing fluid front 126 may, in turn, maximize the expected ultimate oil recovery (EUR). When the production optimizer unit 512 determines a proposed production path that minimizes the objective function below a pre-specified tolerance, the production optimizer unit 512 may stop the iterations, and propose an optimized production path and/or an optimized wellbore trajectory.

The historical data unit 514 may be used to update, or history match, the models (the reservoir model, the production path model, and/or the fluid path model) as data is collected during drilling, completing and/or production of the wellsite 100. With the updated data, the production optimizer unit 512 may perform more iterations in order to further optimize the objective function. Each of the new optimized objective functions may then be collected by the historical data unit 514 in order to determine if the production path, any production path parameters, and/or the wellbore may be modified in order to further optimize production at the wellsite. The historical data unit 514 may then propose one or more updated production path parameters, and/or updated wellbore trajectories.

The historical data unit 514 may use the Ensemble Kalman Filter (EnKF) technique. The EnKF is a stochastic data assimilation method based on an ensemble of realizations, extending the idea of the Kalman Filter, as a way to infer the system state from measurement. This method may be used to history match a number of realizations together. The result consists of a modified probability distribution curve for each uncertain parameter with the possibility of a different mean and reduced standard deviation.

The operator may begin drilling based on the optimized production path and/or the optimized wellbore trajectory. During the drilling and completions of the wellbore 103 and the production path, more reservoir data and/or wellbore data may be collected by the reservoir data unit 504. The new data may be used to generate updated reservoir models, production path models, and/or fluid flow models which may be used by the production optimizer unit 512 as described above. The historical data unit 514 may then use the data regarding the optimized objective function to propose one or more updated production paths and/or wellbore trajectories. During the drilling, the data from the historical data unit 514 may be used to change the drilling trajectory to avoid certain reservoir formations, and/or hazards. During completions, the data from the historical data unit 514 may be used to change equipment parameters, such as the type of control devices 116 used, the nozzle sizes, the nozzle locations, the screen types and the like. Once the wellbore 103 is completed, if the control devices are ICVs 300, little may be done to change the production path parameters. Therefore, when using the control devices ICVs 300 the production control unit 120 may be used to plan and complete wellbore 103.

During production of the reservoir 105 (as shown in FIG. 1), the production control unit 120 may be used in conjunction with the FCV 400 (as shown in FIGS. 4A and 4B) in order to further optimize production. During production data may be periodically and/or continuously collected from the production path, the wellbore 103, and/or the reservoir 105 using the sensors 406 (as shown in FIGS. 4A and 4B). This data may be collected by the reservoir data unit 504. Using the production optimizer unit 512 and the historical data unit 514 as similar manner as described above, a new production path may be determined by the historical data unit 514. For example, the new production path may determine that inflow from the reservoir 105 needs to be slowed at one of the FCVs 400 and/or increased at another FCV 400. The controller 118 may then actuate the valves 402 in the FCVs 400 in order to maximize the production of the reservoir 105 during production. This step may be repeated throughout the production life of the reservoir 105 as desired. The model updating may be part of a feedback control loop along with the actuated valves that continuously alters the settings of the FCV 400 valves to control the shape of the advancing fluid front 126.

The system 102 may use the production control unit 120 to model continuously in order to optimize production of the reservoir by controlling the advancing fluid front 126. The system 102 may be used, for example, in three modes: 1) forward modeling mode 2) The optimization mode to determine the control device 116 spacing and settings and 3) history matching mode.

Figure 6:
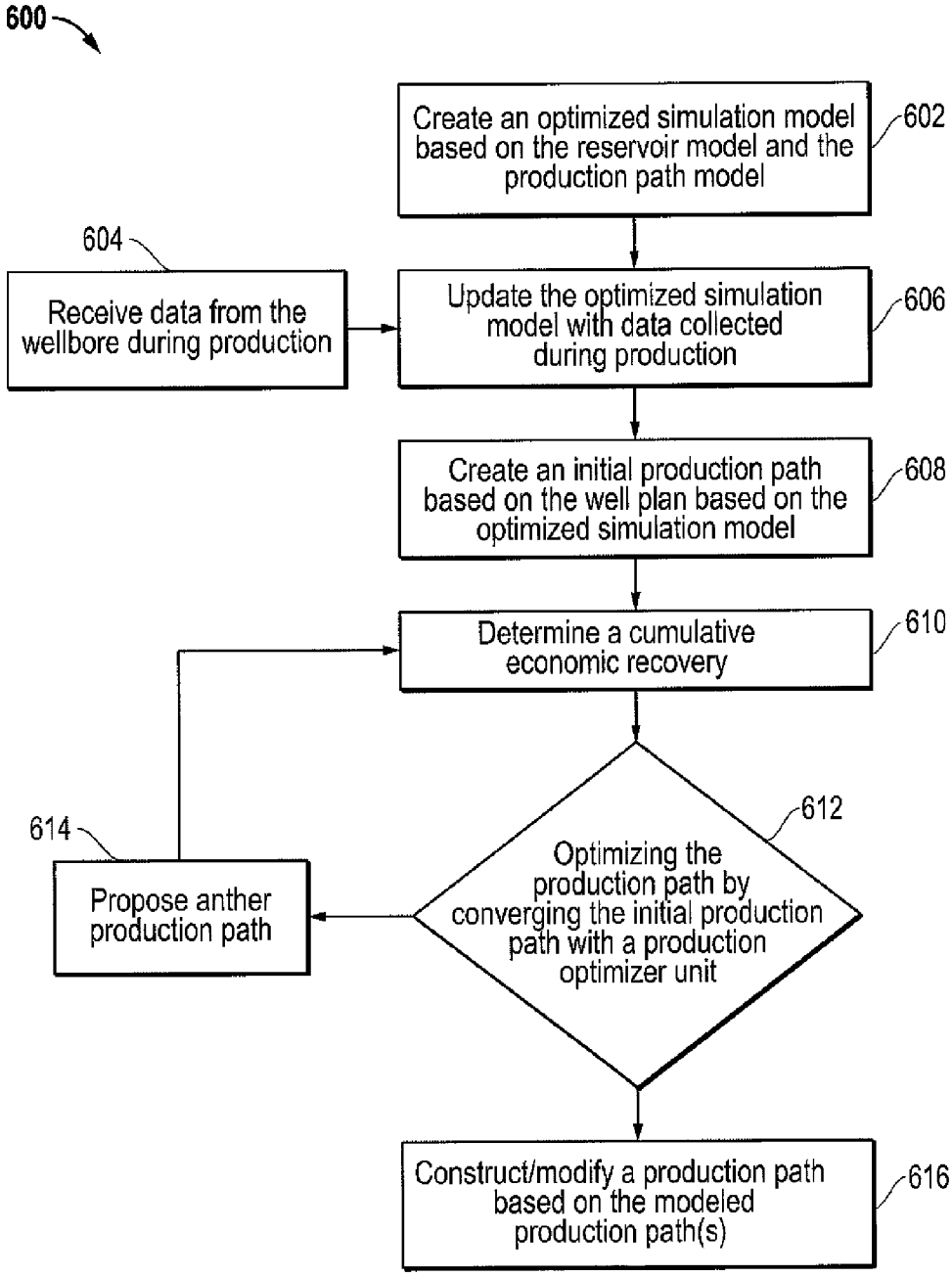
FIG. 6 is a flowchart depicting a method for controlling the advancing fluid front in the reservoir.

FIG. 6 is a flowchart 600 depicting a method for controlling the advancing fluid front 126 in the reservoir 105. The method starts by creating 602 an optimized simulation model based on the reservoir model and the production path model. The method continues by optionally receiving 604 data from the wellbore during production of the reservoir. The method continues by optionally updating 606 the optimized simulation model with data collected during production. The method continues by creating 608 an initial production path based on the well plan based on the optimized simulation model and determining 610 a cumulative economic recovery. The method continues by optimizing 612 the production path by converging the initial production path with a production optimizer unit. If the optimized production path does not meet a minimum objection function, the method continues by proposing 614 another production plan and repeating step 610. If the optimized production path does meet a minimum objection function, the method continues by constructing 616, and/or modifying a production path based on the modeled production paths.

While the embodiments are described with reference to various implementations and exploitations, it will be understood that these embodiments are illustrative and that the scope of the inventive subject matter is not limited to them. Many variations, modifications, additions and improvements are possible. For example, the techniques used herein may be applied across one or more wellsites in one or more a fields with one or more reservoirs.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An integrated production control unit for controlling an advancing fluid front of fluid in a reservoir toward a wellbore at a wellsite, the production control unit comprising:

a reservoir model unit for producing a reservoir model;

a production path unit for producing a production path model that determines at least one pressure parameter about the wellbore during a life of the wellbore; and a processor that executes a production optimizer unit for producing a well plan that optimizes at least one function of the wellsite and defines a production path based on the reservoir model and the production path model, the production optimizer unit controlling the advancing fluid front in the reservoir along horizontal portions of the wellbore with a plurality of control devices and a plurality of flow controllers optimally positionable along a plurality of vertical slices defining permeability zones, such that a line defining a leading edge of the advancing fluid front is maintained substantially flat and parallel to an axis of the horizontal portions of the wellbore along the zones as the advancing fluid front approaches the wellbore whereby premature breakthrough of the fluid into the wellbore is prevented.

2. The integrated production control unit of claim 1, further comprising a historical data unit for updating the well plan based on data obtained during drilling.

3. The integrated production control unit of claim 1, further comprising a historical data unit for updating the well plan based on data obtained during production and wherein the updated well plan is used to change the at least one pressure parameter.

4. The integrated production control unit of claim 1, wherein the at least one pressure parameters is changed by actuating a valve of the plurality of control devices.

5. The integrated production control unit of claim 1, wherein the at least one pressure parameter is a pressure drop.

6. The integrated production control unit of claim 1, further comprising a fluid flow unit for producing a fluid flow model, wherein the fluid flow model may determine a fluid parameter in the wellbore at an interface between a reservoir and the production path.

7. A system for controlling an advancing fluid front of a fluid in a reservoir toward a wellbore at a wellsite, the system comprising:

a production path located in the wellbore for producing the fluid fluids from the reservoir, the production path comprising:

a base pipe for flowing the fluid from the reservoir;

a plurality of control devices and flow controllers that control the flow of the fluid from the reservoir into the base pipe; and a production control unit comprising:

a reservoir model unit for producing a reservoir model;

a production path unit for producing a production path model that determines at least one pressure parameter about the wellborn during a life of the wellbore; and a processor that executes a production optimizer unit for producing a well plan that optimizes at least one function of the wellsite and defines a production path based on the reservoir model and the production path model, the production optimizer unit controlling the advancing fluid front in the reservoir along horizontal portions of the wellbore with a plurality of control devices and a plurality of flow controllers optimally positionable along a plurality of vertical slices defining permeability zones, such that a line defining a leading edge of the advancing fluid front is maintained substantially flat and parallel to an axis of the horizontal portions of the wellbore along the zones as the advancing fluid front approaches the wellbore whereby premature breakthrough of the fluid into the wellbore is prevented.

8. The system of claim 7, wherein the plurality of flow controllers comprises at least one packer located in an annulus of the wellbore between the base pipe and an inner wellbore wall.

9. The system of claim 7, wherein the plurality of control devices further comprises a screen for preventing sands from entering the base pipe.

10. The system of claim 7, wherein the plurality of control devices further comprises at least one nozzle creating a fluid path for flowing the fluid into the base pipe.

11. The system of claim 10, wherein the plurality of control devices further comprises at least one valve for selectively changing the size of the fluid path.

12. The system of claim 11, further comprising a controller for selectively actuating the at least one valve.

13. The system of claim 12, further comprising at least one sensor for detecting at least one production path parameter during production of the reservoir.

14. A method for controlling an advancing fluid front a fluid in a reservoir toward a wellbore at a wellsite, the method comprising:

providing a production control unit comprising:

a reservoir model unit for producing a reservoir model;

a production path unit for producing a production path model that determines at least one pressure parameter about the wellbore during a life of the wellbore; and a processor that executes a production optimizer unit for producing a well plan that optimizes at least one function of the wellsite and defines a production path based on the reservoir model and the production path model, the production optimizer unit controlling the advancing fluid front in the reservoir along horizontal portions of the wellbore with a plurality of control devices and a plurality of flow controllers optimally positionable along a plurality of vertical slices defining permeability zones, such that a line defining a leading edge of the advancing fluid front is maintained substantially flat and parallel to an axis of the horizontal portions of the wellbore along the zones as the advancing fluid front approaches the wellbore whereby premature breakthrough of the fluid into the wellbore is prevented;

creating an optimized simulation model based on the reservoir model and the production path model;

creating an initial production path based on the well plan based on the optimized simulation model;

constructing the production path having the plurality of control devices based on the initial production paths; and controlling the advancing fluid front in the reservoir with the plurality of control devices and the plurality of flow controllers.

15. The method of claim 14, further comprising optimizing the production path by converging the initial production path with the production optimizer unit.

16. The method of claim 14, further comprising updating the optimized simulation model with data collected during drilling.

17. The method of claim 14, further comprising sensing the at least one pressure parameter about the wellbore using at least one sensor during production of the reservoir.

18. The method of claim 17, further comprising updating the optimized simulation model with the data collected by the at least one sensor.

19. The method of claim 18, further comprising actuating a valve in the production path thereby changing the at least one pressure parameter in the production path and thereby controlling the advancing fluid front.

20. The method of claim 19, further comprising updating the optimized simulation model during a production life of the reservoir thereby increasing the production capacity of the reservoir.

* * * * *

UNITED STATES PATENT AND TRADEMARK OFFICE

CERTIFICATE OF CORRECTION

PATENT NO. : 8,700,371 B2
APPLICATION NO. : 12/837550
DATED : April 15, 2014
INVENTOR(S) : Thambynayagam et al.

It is certified that error appears in the above-identified patent and that said Letters Patent is hereby corrected as shown below:

On the title page item (75), line 1, should read --Raj Kumar Michael Thambynayagam--

Signed and Sealed this
Ninth Day of February, 2016

Michelle K. Lee

Michelle K. Lee
*Director of the United States Patent and Trademark Office*